US005946725A

United States Patent [19]

Shatzkin et al.

[11] Patent Number: 5,946,725

[45] Date of Patent: Sep. 7, 1999

[54] ADULT INFANT BONDING GARMENT

[76] Inventors: Ellen Shatzkin, 53 Beverly Rd., White Plains, N.Y. 10605; Madeline Williams, 25 Knights Cir., Newburgh, N.Y. 12550

[21] Appl. No.: 09/120,785

[22] Filed: Jul. 22, 1998

[51] Int. Cl.[6] ..... A41D 1/18

[52] U.S. Cl. ..... 2/106; 2/94; 2/104; 224/159

[58] Field of Search ..... 2/93, 94, 95, 97, 2/102, 104, 106, 107, 108, 111, 114, 247, 118, 85, 88; 224/159, 158, 160

[56] References Cited

U.S. PATENT DOCUMENTS

| | | | |
|---|---|---|---|
| D. 370,090 | 5/1996 | Coggins . | |
| 399,436 | 3/1889 | Reinhard | 2/95 |
| 416,970 | 12/1889 | Taylor . | |
| 484,065 | 10/1892 | Taylor . | |
| 2,010,903 | 8/1935 | Swanson . | |
| 2,051,482 | 8/1936 | Hyman | 2/95 |
| 2,069,579 | 2/1937 | Epstein | 2/95 |
| 2,301,527 | 11/1942 | English et al. | 2/95 |
| 2,376,657 | 5/1945 | Chamberlain . | |
| 2,599,474 | 6/1952 | Mills . | |
| 2,968,044 | 1/1961 | Dudley . | |
| 3,034,132 | 5/1962 | Landsberger . | |
| 3,229,873 | 1/1966 | Hershman . | |
| 4,079,467 | 3/1978 | Baldwin . | |
| 4,172,300 | 10/1979 | Miller . | |
| 4,402,440 | 9/1983 | Purtzer et al. . | |
| 4,428,514 | 1/1984 | Elf . | |
| 4,434,920 | 3/1984 | Moore . | |
| 4,467,945 | 8/1984 | Schaapveld . | |
| 4,492,326 | 1/1985 | Storm . | |
| 4,497,071 | 2/1985 | Bell | 2/94 |
| 4,567,611 | 2/1986 | Kendrick . | |
| 4,606,078 | 8/1986 | Tkacsik . | |
| 4,663,782 | 5/1987 | Knox et al. . | |
| 4,797,954 | 1/1989 | Williams et al. . | |
| 4,903,873 | 2/1990 | Poole et al. . | |
| 5,005,217 | 4/1991 | Bern et al. . | |
| 5,071,047 | 12/1991 | Cordisco . | |

(List continued on next page.)

OTHER PUBLICATIONS

Whitelaw et al; Myth of the Marsupial Mother: Home Care of Very Low Birth Weight Babies in Bogota, Colombia. The Lancet May 25, 1985;1 (8439): 1206–8.

Anderson GC; Skin to Skin:Kangaroo Care in Western Europe. American Journal of Nursing 1989;89(5):662–6.

Charpak et al: Rey–Martinez Kangaroo Mother Program:An Alternate Way of Caring for Low Birth Weight Infants? One Mortality in a Two Cohort Study. Pediatrices 1994;94:804–810.

Sloan NL et al; Kangaroo Mother Method;Randomised Controlled Trial of an Alternate Method of Care For Stabilised Low–Birthweight Infants. The Lancet Sep. 17, 1994;344(8925):782–5.

Bauer K et al; Body Temperatures and Oxygen Consumption During Skin–to–Skin (Kangaroo) Care in Stable Preterm Infants Weighing Less Than 1500 Grams. The Journal of Pediatrics 1997;130:240–244.

Bauer J et al; Metabolic Rate and Energy Balance in Very Low Weight Infants During Kangaroo Holding by Their Mothers and Fathers. The Journal of Pediatrics 1996;129:608–611.

Ludington–Hoe SM et al; Developmental Aspects of Kangaroo Care. Journal of Obstetric Gynecologic, and Neonatal Nursing 1996;25 980;691–703.

(List continued on next page.)

*Primary Examiner*—Amy Vanatta
*Attorney, Agent, or Firm*—Kane, Dalsimer, Sullivan, Kurucz, Levy, Eisele and Richard, LLP

[57] ABSTRACT

An article of clothing such as a shirt or blouse which allows for Kangaroo Care by providing skin to skin contact between a person and infant which includes a pouch or pouches on the inside of the shirt centrally located thereon in which the infant may be placed. A larger pouch for a more developed infant may also be provided.

16 Claims, 9 Drawing Sheets

U.S. PATENT DOCUMENTS

| | | | |
|---|---|---|---|
| 5,097,536 | 3/1992 | Cohen . | |
| 5,182,813 | 2/1993 | Booze . | |
| 5,243,724 | 9/1993 | Barnes . | |
| 5,246,152 | 9/1993 | Dotseth . | |
| 5,259,068 | 11/1993 | Carroll | 2/104 |
| 5,267,352 | 12/1993 | Rodarmel | 2/108 |
| 5,333,768 | 8/1994 | Krentz . | |
| 5,454,119 | 10/1995 | Thomm . | |
| 5,544,364 | 8/1996 | Weber . | |
| 5,570,823 | 11/1996 | Lindy . | |
| 5,611,083 | 3/1997 | Arnold . | |
| 5,632,425 | 5/1997 | Hull . | |
| 5,678,739 | 10/1997 | Darling et al. | 224/158 |
| 5,690,258 | 11/1997 | Kataoka . | |
| 5,722,094 | 3/1998 | Ruefer . | |

OTHER PUBLICATIONS

Als H. et al; Individualized Developmental Care For the Very Low–Birth–Weight Preterm Infant–Medical and Neurofunctional Effects. The Journal of the American Medical Association. 1994;272:853–858.

Anderson GC; Current Knowledge About Skin–to–Skin (Kangaroo) Care for Preterm Infants. Journal of Perinatology 1996;XI:216–226.

Ludington–Hoe SM et al; Kangaroo Care: Research Results, and Practice Implications and Guidelines. Neonatal Network 1994:13(1):19–27.

Gale G et al; Skin–to–Skin (Kangaroo) Holding of the Intubated Premature Infant. Neonatal Network; 1993;12(6):49–57.

Paulsen Bell R et al; Implementing a Research–Based Kangaroo Care Program in the NICU. Nursing Clinics of North America 1991;31(2):387–403.

Hamelin K. et al; Kangaroo Care. Canadian Nurse 1993;89:15–17.

Sontheimer D. et al; Pitfalls in Respiratory Monitoring of Premature Infants During Kangaroo Care. Archives of Disease in Childhood 1995; 72:F115–F117.

ADULT INFANT BONDING GARMENT

BACKGROUND OF THE INVENTION

1. Field of the Invention

The invention relates generally to a article of clothing, and more particularly to a upper body garment which is worn by an adult for skin to skin bonding with a newborn. The upper body garment features a dual pouching mechanism.

2. Discussion of the Prior Art

The concept of Kangaroo Maternal Care or Kangaroo Care was developed secondarily to increased morbidity and mortality caused by infection, a dearth of materials and services and overcrowding in the newborn intensive care units in Bogota, Columbia. To combat the unfavorable conditions, new mothers were encouraged to exclusively hold their infants on their chest, skin to skin. Studies later determined that by doing this infants were gaining weight better and were discharged home sooner at weights less than standard United States protocols. Sicker oxygen dependent infants weaned off oxygen sooner. Further studies in the United States documented Kangaroo Care as helpful to newborns in the well equipped Neonatal Intensive Care Units even for the small low birth weight premature infants. The goals are to allow the infant to be comfortable, feel the adult heartbeat and descend into a deep sleep stage. One proposed theory is that in deep sleep, growth hormone is produced and the infant should grow better.

Infants on their mothers chest will attempt to nurse, which for the breast-feeding mother is another encouraging goal. However, at this time, there is not a convenient method to manage this care, in addition to the other aspects of Kangaroo Care. Prior art nursing garments such as U.S. Pat. No. 4,567,611 issued Kendrick February, 1986; U.S. Pat. No. 4,663,782 issued Knox May, 1987; U.S. Pat. No. 5,005,217 issued Bern April, 1991; U.S. Pat. No. 5,182,813 issued Booze February, 1993; U.S. Pat. No. 5,544,364 issued Weber August, 1996 show various manners for nursing either through or under the blouse. None of the above mentioned art provides for developmental bonding or for allowing the newborn to be maintained in a comfortable sleeping position before or after breast-feeding while leaving the mother's hands relatively free for other activities.

Blouses currently in fashion are inconvenient in that there is either poor access to place the baby on the chest or not enough material to close around parent and infant. The other alternative to remove the blouse/shirt and cover baby with a blanket for modesty and additional warmth is awkward and embarrassing. Various infant blanket or warming devices such as U.S. Pat. No. 2,968,044 issued Dudley July, 1957; U.S. Pat. No. 3,034,132 issued Landsberger May, 1962; U.S. Pat. No. 4,172,300 issued Miller October, 1979; U.S. Pat. No. 5,243,724 issued Barnes September, 1993; U.S. Pat. No. 5,722,094 issued Ruefer March, 1998; could be used to help adults hold their newborns warmly but they do not provide a securing mechanism to the holder. The purpose of Kangaroo Care is to provide skin to skin contact using the holder as the heat source or incubator. By swaddling the newborn, the primary purpose of skin to skin contact is not being met.

With the current fashions, the adult must have both hands available to keep the infant securely in position. It is very difficult to hold infants with intravenous support, monitoring equipment and oxygen supplementation. There is a constant fear of dropping the baby. This uncomfortable feeling can be transmitted to the baby preventing the newborn from entering a deep sleep stage. Without something to keep the parent occupied, sitting for hours can be boring and again prevent the deep sleep needed for healing and growth.

While front loading Infant/baby Carriers so allow both hands to be free such as U.S. Pat. No. 416,970 issued Taylor December, 1889; U.S. Pat. No. 484,065 issued Taylor October, 1892; U.S. Pat. No. 2,376,657 issued Chamberlain May, 1945; U.S. Pat. No. 2,599,474 issued Mills June, 1952; U.S. Pat. No. 3,229,873 issued Hershman January, 1966; U.S. Pat. No. 4,402,440 issued Purtzer September, 1983; U.S. Pat. No. 4,428,514 issued Elf January, 1984; U.S. Pat. No. 4,434,920 issued Moore March, 1984; U.S. Pat. No. 4,467,945 issued Schaapveld August, 1984; U.S. Pat. No. 4,492,326 issued Storm January, 1985; U.S. Pat. No. 4,903,873 issued Poole February, 1990; U.S. Pat. No. 5,071,047 issued Cordisco December, 1991; U.S. Pat. No. 5,246,152 issued Dotseth September, 1993; U.S. Pat. No. 5,570,823 issued Lindy November, 1996; U.S. Pat. No. 5,632,425 issued Hull May, 1997; U.S. Pat. No. 5,690,258 issued Kataoka November, 1997 and pet carrier U.S. Pat. No. D370,090 issued Coggins May, 1996 free the hands for other activities, none of them provide for the primary purpose of Kangaroo Care. They do not allow for comfortable breast-feeding or for skin to skin contact with attached covering. To a new mother it is not a very modest or comfortable way of holding their baby for a prolonged inactive time when the goal is to allow the baby to progress to a deep sleep.

Prior art for infant carriers or infant supporters made primarily for transportation did not consider this more passive and gentle modality. The carriers are slings or papoose like structures that do not allow for skin to skin contact if desired. They would be uncomfortable for the adult to wear for extended periods of immobile time. While several prior art demonstrate flexible pouches and have ready access for changing diapers, they are still quite restricting and certainly are not made for the low or very low birth weight newborns. None of the prior art has a pocket pouch for low or very low birth weight babies attached to the large pouch which in turn is attached to the inner aspect of the front panel of the garment. This pocket pouch allows the infant to curl into the more normal fetal position while resting on their adult holder's chest.

U.S. Pat. No. 4,079,467 issued Baldwin March, 1978 and U.S. Pat. No. 4,606,078 issued Tkacsik September, 1986 while encompassing the overall cover and front loading goals are made for use outside the home as protection from the elements not for the intimate use of quiet inactive time.

Front opening blouses U.S. Pat. No. 2,010,903 issued Swanson August, 1935; U.S. Pat. No. 4,797,954 issued Williams January, 1989; U.S. Pat. No. 5,097,536 issued Cohen March, 1992 are without a pouching mechanism. They do not serve as a developmental holding unit regardless of the flexibility of a frontal opening.

U.S. Pat. No. 5,333,768 issued Krentz August, 1994; U.S. Pat. No. 5,454,119 issued Thomm October, 1995; U.S. Pat. No. 5,611,083 issued Arnold March, 1997 are all associated with pouch mechanisms. However, U.S. Pat. No. 5,333,768 is a separate unit to be worn with straps attached only to the pouching mechanism under a garment. While U.S. Pat. No. 5,454,119 has a front opening and a front pouch it is not designed or capable for use as an infant holder. U.S. Pat. No. 5,611,083 has a front pouch attached to the inside of the front panel. Its design does not allow for ready access to front load an infant into the pouch nor does allow for larger infants to fit comfortably for extended periods of time. The pouch is singular not dual.

Many new mothers are apprehensive about holding their infants especially when they are sick or fragile. When in the Neonatal Intensive Care Unit, ill infants are not routinely held preventing bonding between mother, father and baby. This garment is designed to help parents create that familial bond as early as possible by providing a safe, cozy, comfortable environment.

SUMMARY OF THE INVENTION

The present invention pertains to a upper body garment made of a flexible material to be used both as a adequate comfortable garment and as a newborn supportive device via a dual pouching mechanism comprising of a first part with reinforced sides and crotch seam and a second part secured to the first of a three sided enclosed pocket. According to the invention there is a front and back panel with space allotted for sleeve openings and sleeves which are integrally formed in continuation with one another. On the reverse side of the front panel the dual pouching mechanism is attached.

The front panel is designed for better access for placing the infant within the pouching mechanism by a longer than routine blouse center front placket, longer than normal lateral front placket or longer than normal dual side plackets. The extension of the neckline in all of the configurations allow for easy access for placing and removing any size infant with any oxygen or monitoring support. The front panel is generous in material to allow for comfortable enclosure of the infant.

Both the pocket pouch and the larger seater pouch have an adjustable elastic band to accommodate for size. This is an important element secondarily to the growth of premature and term infants. Low birth weight and very low birth weight infants would be placed utilizing the smaller pocket pouch which is enclosed on three sides. This allows the very small newborns to stretch and curl up at will. The growing premature infant would graduate to the larger seater pouch which has two reinforced sides and space for a leg on either side of a reinforced crotch seam.

The Neonatal Intensive Care Unit staff will be less apprehensive of their charges when secured in the garment. The garment allows for continued monitoring and ability to easily check the infant. Any parent concerned with the emotional and neurodevelopment of newborns as currently advocates in the scientific and popular media would feel less apprehensive in participating with the infant's care.

BRIEF DESCRIPTION OF THE DRAWINGS

The above and other objects, advantages and features will be apparent from the following description of a preferred embodiment, considered along with the accompanying drawings wherein.

DETAILED DESCRIPTION OF THE PREFERRED EMBODIMENT

Figure 1:
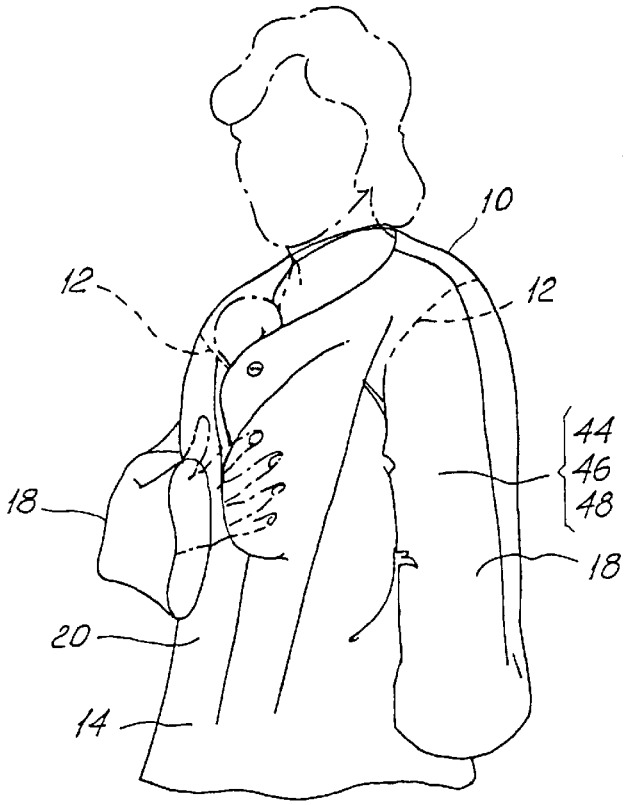
FIG. 1 is an oblique front view of a upper body garment according to the invention as employed for providing contact between a human and an infant.

FIG. 1 shows, in an oblique frontal view, an upper body garment 10 preferably formed of a soft, breathable, flexible material. In this view an adult is shown using the pocket pouches 44, 46, 48 of various configurations of the inner dual pouching mechanism 42. The upper body garment 10 also includes a pair of sleeves 18 secured to the front panel 14 of the body portion 20 at the shoulder seam 12, as by stitching.

Figure 2:
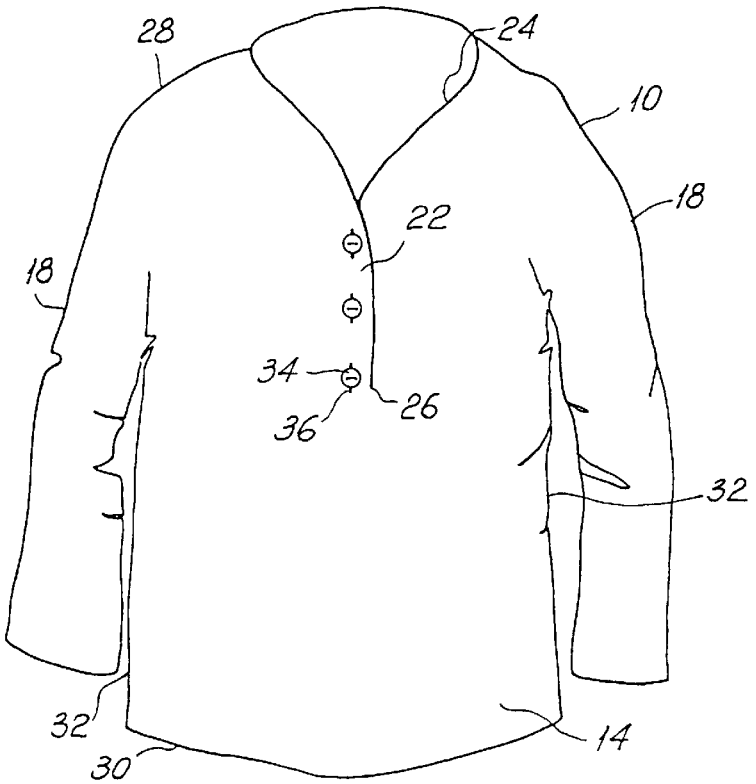
FIG. 2 is a front perspective view of a upper body garment of FIG. 1 with a centered placket.
Figure 4:
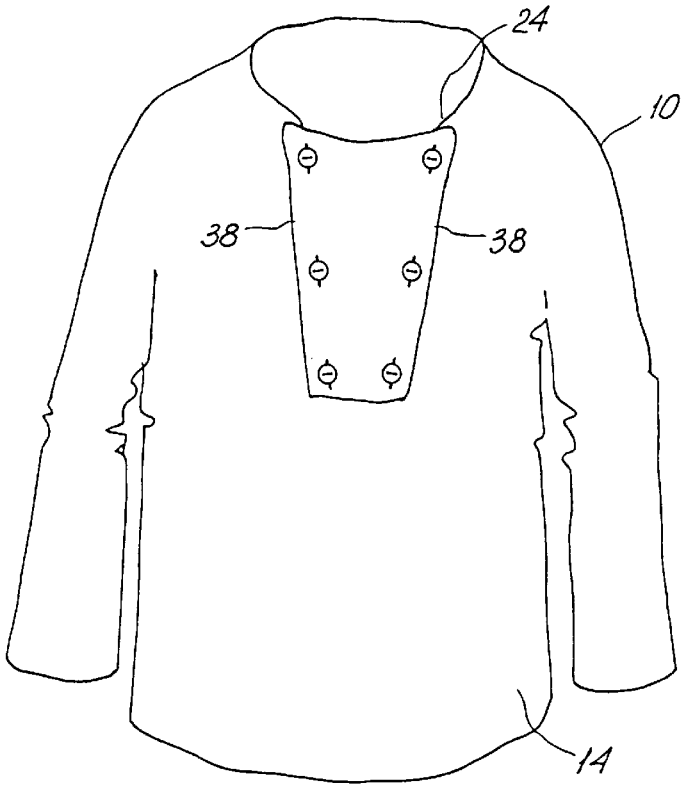
FIG. 4 is a front perspective view of a upper body garment of FIG. 1 with two side plackets.
Figure 3:
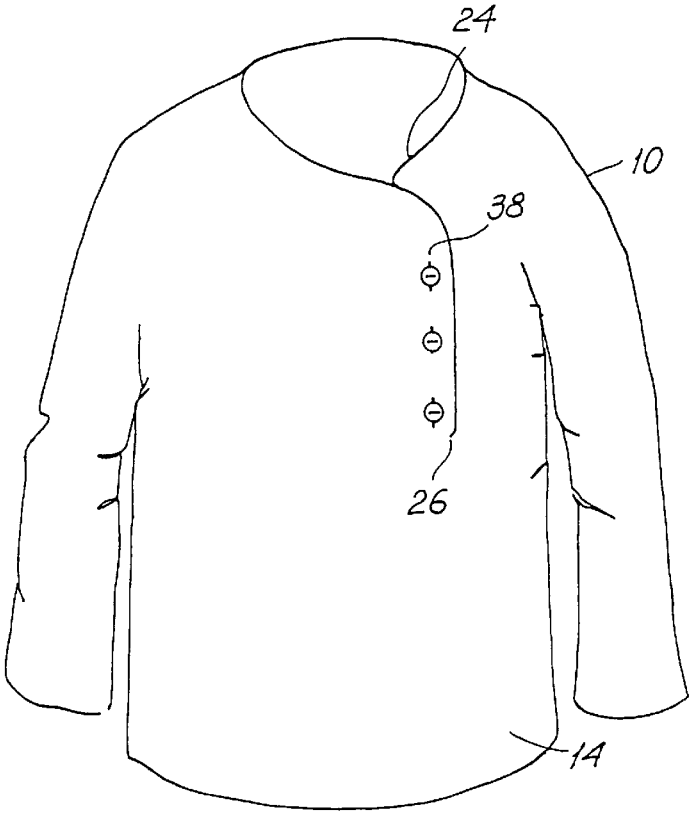
FIG. 3 is a front perspective view of a upper body garment of FIG. 1 with a side placket.

FIGS. 2, 3 and 4 illustrate the front view of the general configuration of an upper body garment 10 constructed according to the invention when employed as a pullover-type, hip length garment. Front 14 and back 16 panels of the garment, are sewn together to form a side seam 28 from shoulder to hip hem 30 leaving space for a sleeve 18 on each side. In FIG. 2 the neckline 24 converges to a center placket 22 extending at or near midline or end of placket 26 of the full upper garment 10 length centered from each lateral side 32 and is secured with a series of buttons 34 and buttonholes 36 equally spaced. FIG. 3 has the neckline 24 converge off side with a side placket 38 extending near or at midline 26 as in FIG. 2. FIG. 4 has the neckline 24 meet at two side plackets 38 both extending near or at the midline 26 of the upper body garment 10.

Figure 5:
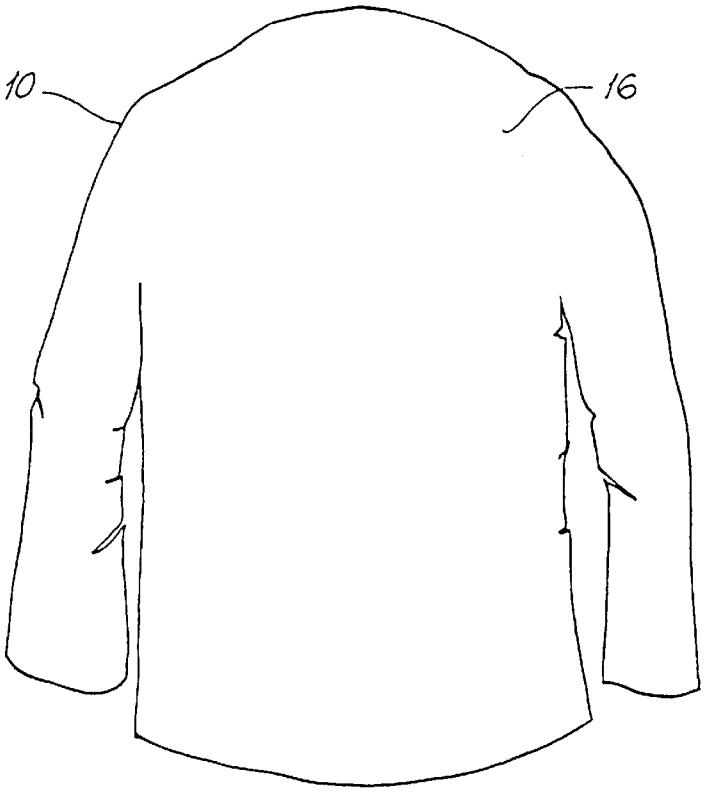
FIG. 5 is a rear perspective view of the upper body garment of FIG. 1.
Figure 6:
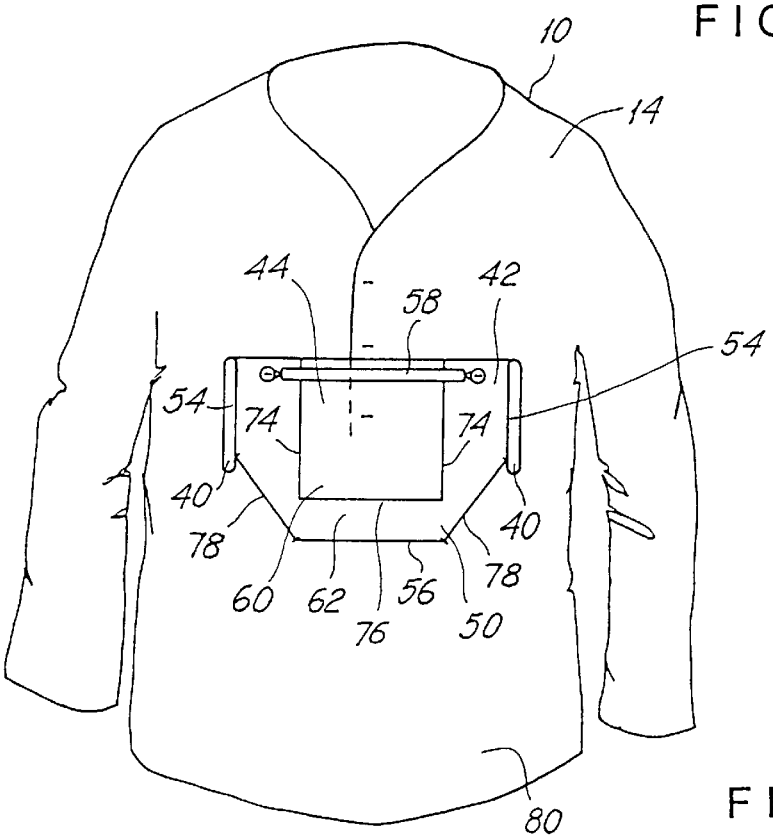
FIG. 6 Is a view of the front perspective of the upper body garment of FIG. 1 with the dual pouching mechanism highlighted.
Figure 7:
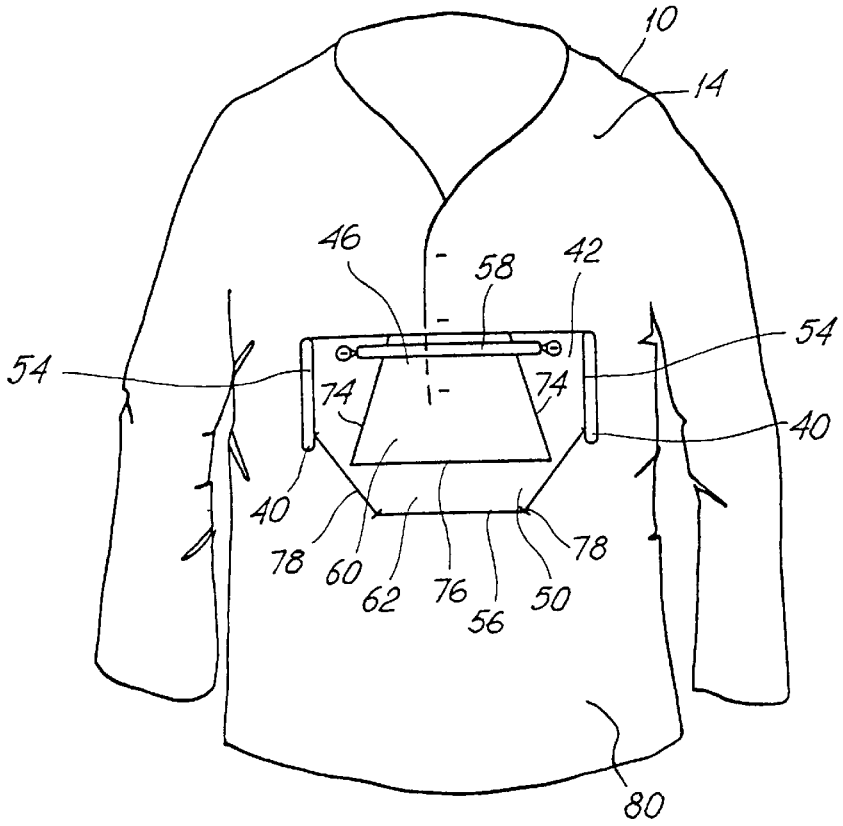
FIG. 7 is a view of the front perspective of the upper body garment of FIG. 1 with an alternate shaped pocket pouch with the dual pouching mechanism highlighted.
Figure 8:
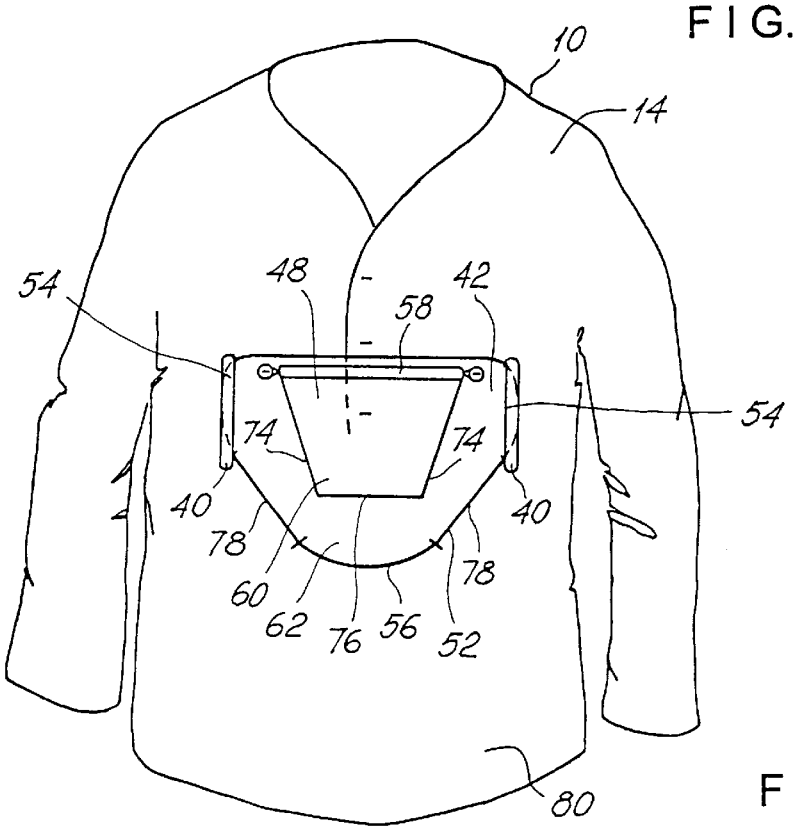
FIG. 8 is a view of the front perspective of the upper body garment of FIG. 1 with a second alternate shaped pocket pouch with the dual pouching mechanism highlighted.

FIG. 5 is a rear view showing the back panel 16 of the upper body garment 10 that extends to hip length. FIGS. 6–8 illustrate the reverse view 80 of the front panel 14 showing the inner dual pouching mechanism 42 with three possible alternate pocket pouch configurations 44 which is somewhat rectangular in shape, 46 which is shaped in the shape of an upside down flower pot, 48 which is shaped as a right side up flower pot each of which may be secured to one of two possible larger seater pouch arrangements 50 or 52. The pocket pouches 44, 46, 48 are secured to the seater pouches 50 or 52 by securing, preferably by reinforced stitching, two side seams 74 and a bottom seam 76. The large central seater pouches 50 which is a polygon in shape, or alternatively, 52 which is larger and more rounded, is formed in the upper portion of the upper garment 10. The preferred construction of the large seater pouches 50 or 52 has reinforced seams 40 on the two lateral seater pouch sides 54, two leg openings 78 and at the crotch 56, a seam reinforced with material such as twill tape, securing it to the interior of the front panel 14. A centered casing mechanism 58 is also shown. Preferably both the pocket pouches 44, 46, 48 and seater pouches 50 and 52 have a gathering of material on the dorsal side 60 pocket pouch and 62 seat pouch, allow for more room for the infant to rest comfortably.

Figure 9:
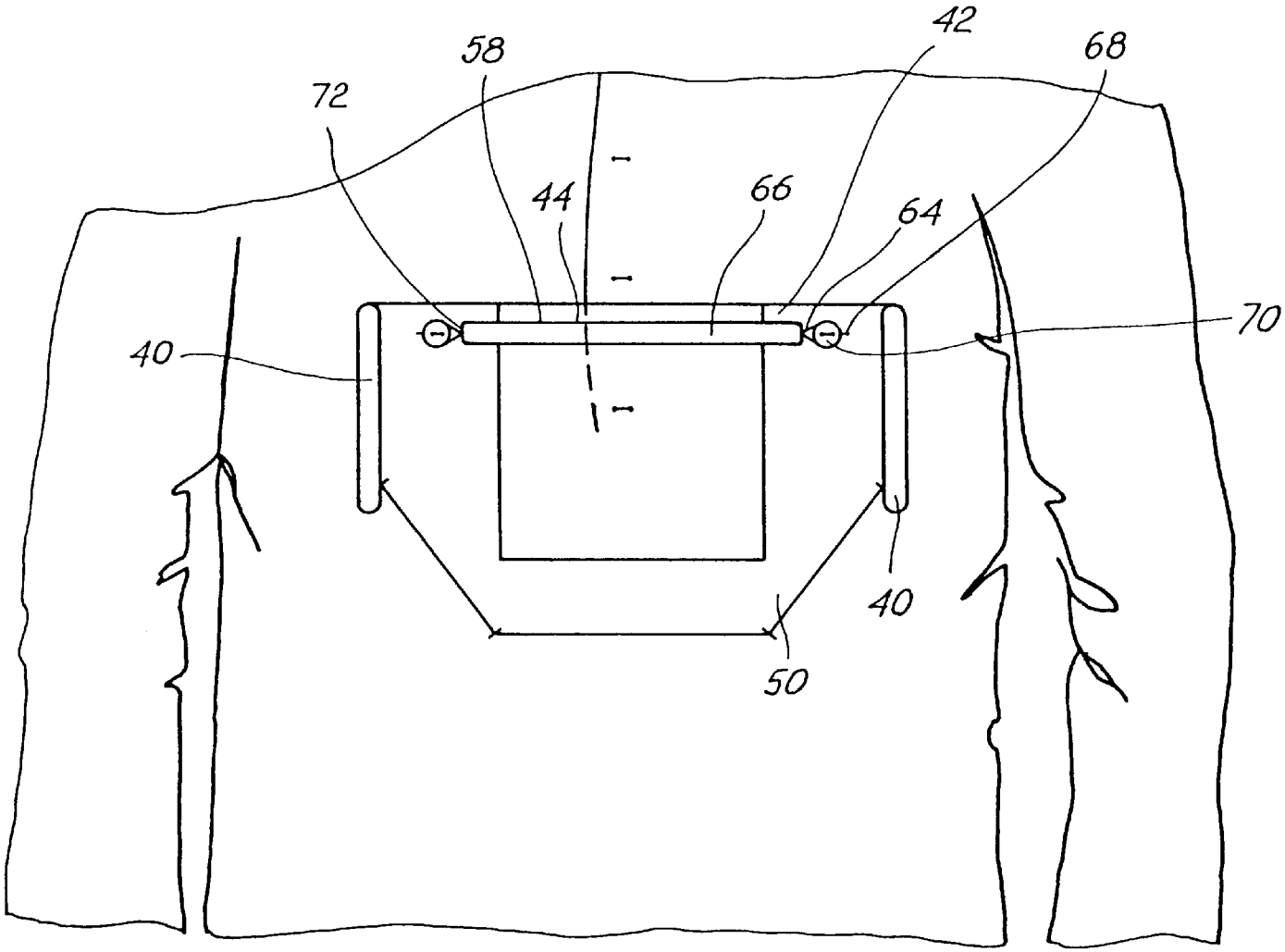
FIG. 9 is an enlarged view of the flexible material pouching mechanism and the casing method that could be used to adjust for size of the infant.

FIG. 9 illustrate the preferred embodiment of the reverse view or interior side 80 of the front panel 14 showing the inner dual pouching mechanism 42 with an enlarged view of center casing mechanism 58 attached to the inner dual pouching mechanism 42 for adjustment to accommodate for the size of the infant. By attaching the material 64, preferably an elastic type material, which is covered by a narrow layer of a flexible material 66, via buttonhole 68 to a stationary button 70 on either side of the casing mechanism opening 72, side differential can be made. Of course other securing means in lieu of buttons may be utilized such as Velcro fasteners if they are secure enough to be suitable for purpose.

Figure 10:
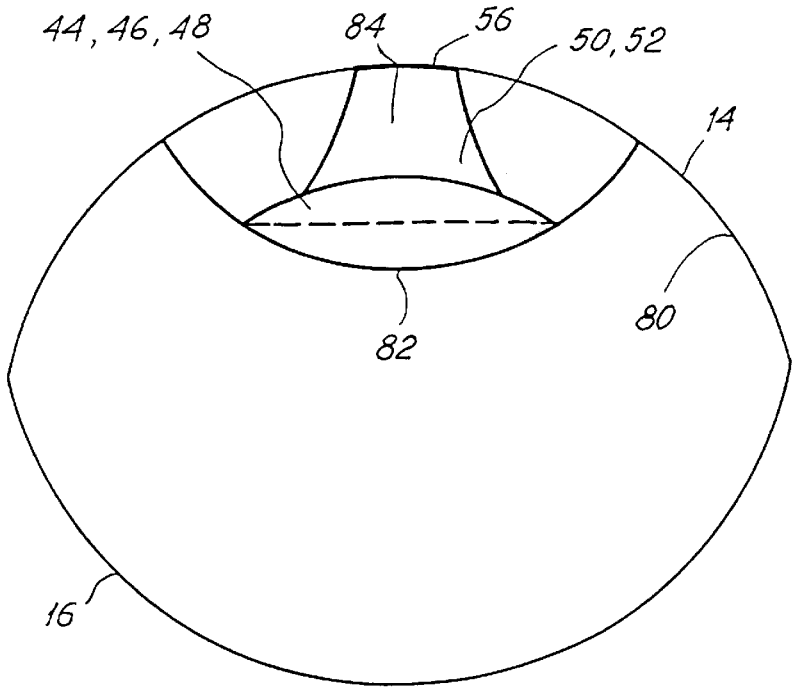
FIG. 10 is a cross section view of the torso section of the upper body garment at an intermediate level.

FIG. 10 is a cross section at mid chest and shows the preferred sequence of attachment of pocket pouches 44, 46, 48 to seater pouches 50 or 52 on the interior side of the panel close the adult's chest 82 which is secured to the interior 80 of the front panel 14. Also noted is the crotch area 84 of the seater pouches 50 and 52 which is also shown.

Figure 11:
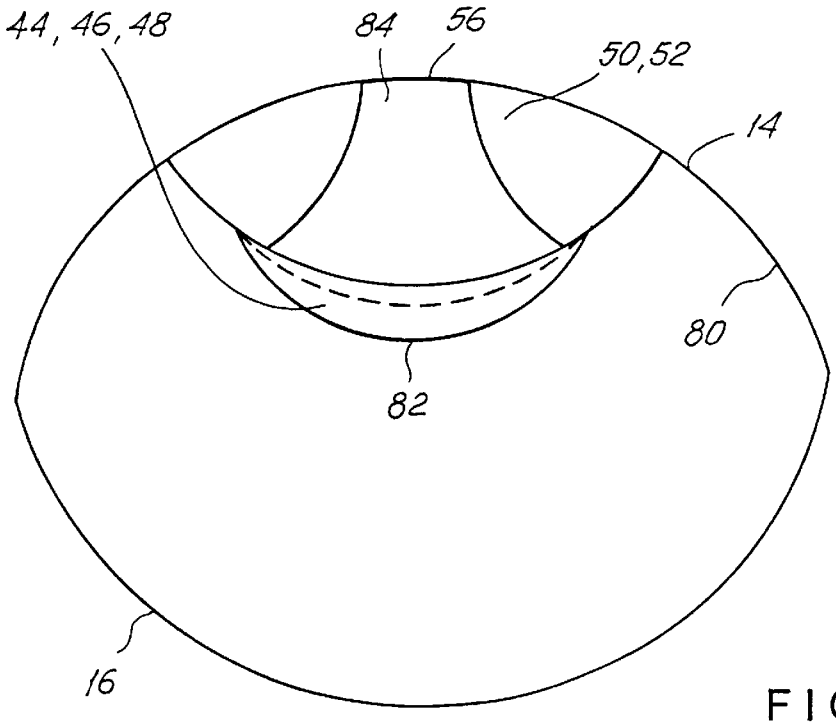
FIG. 11 is a cross section view of the torso section of the upper body garment at an intermediate level with an alternate order of the dual pouching mechanism.

FIG. 11 in a preferred embodiment cross section at mid chest, shows an alternate of pocket pouches 44, 46, 48 to seater pouches 50 or 52 on the exterior side of the panel close the adult's chest 82 which is secured to the interior 80 of the front panel 14. Also, the crotch of the seater pouches 50 and 52 is shown.

Figure 13:
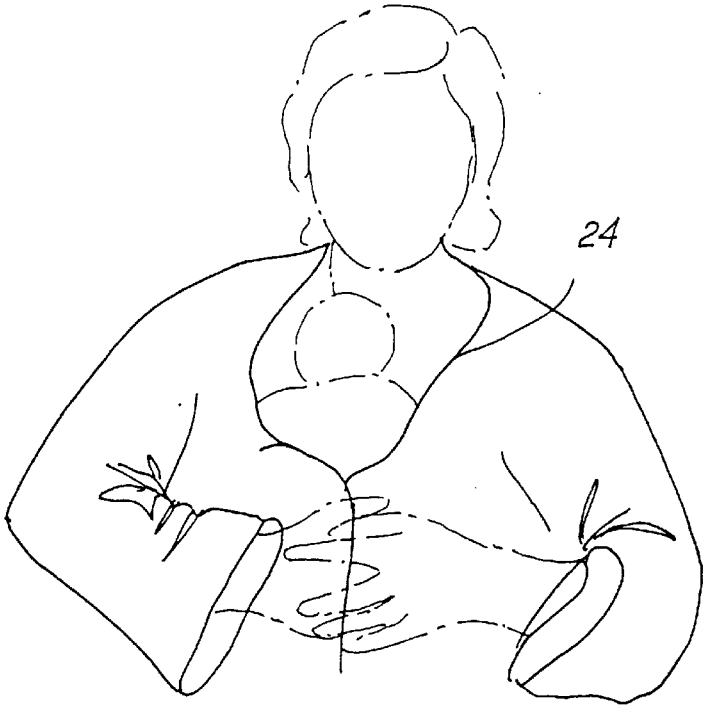
FIG. 13 is a front view of a very low birth weight infant in the pocket pouch with a partially enclosed neckline of the upper body garment with the adult sitting.
Figure 12:
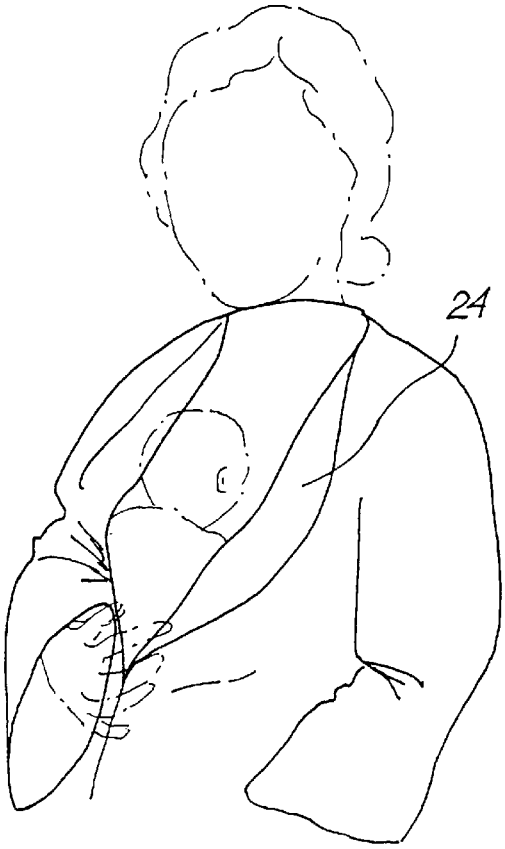
FIG. 12 is a front view of a very low birth weight infant in the pocket couch with the outer placket of the upper body garment opened with the adult standing.

FIGS. 12 and 13 show the same infant as in FIG. 1 with the neckline 24 adjusted for the fully enclosed position and partially enclosed position respectively.

Figure 14:
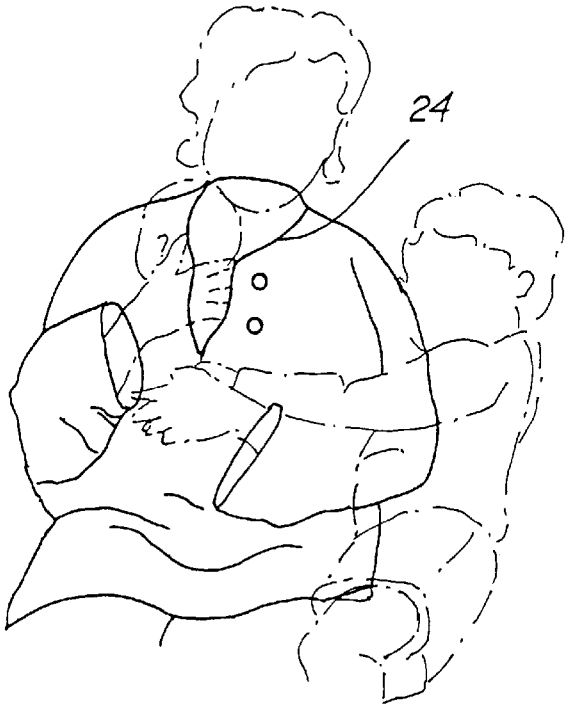
FIG. 14 is a front view of a full term infant sitting in the seater pouch with a partially enclosed neckline of the upper body garment with the adult sitting and a young child sitting next to the adult.

FIG. 14 shows the use of the seater pouches 50 and 52 for a full term infant as the adult maintains a sitting position. In this view, the neckline 24 is partially enclosed demonstrating the freedom of movement allowed the infant.

Figure 15:
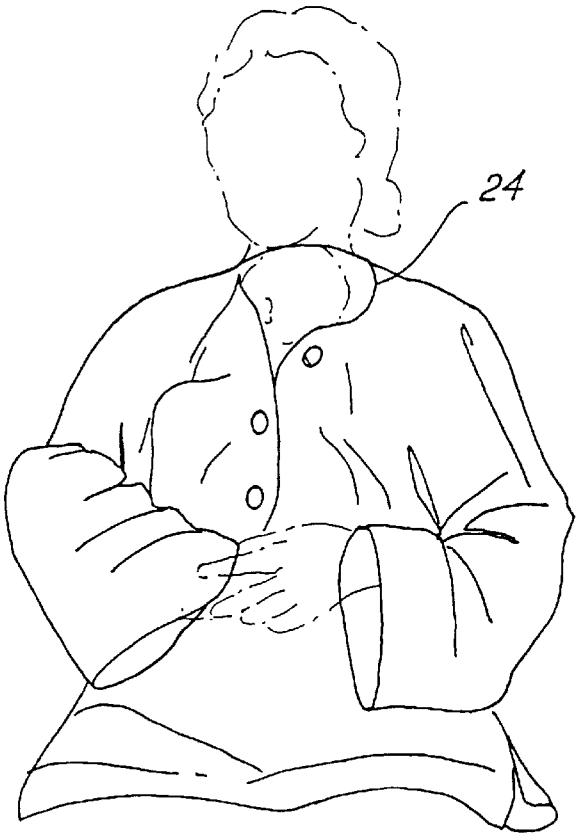
FIG. 15 is a front view of a full term infant sitting in the seater pouch with a fully enclosed neckline and with the adult sitting.

FIG. 15 illustrates the use of the neckline 24 fully enclosed with a full term infant.

Figure 16:
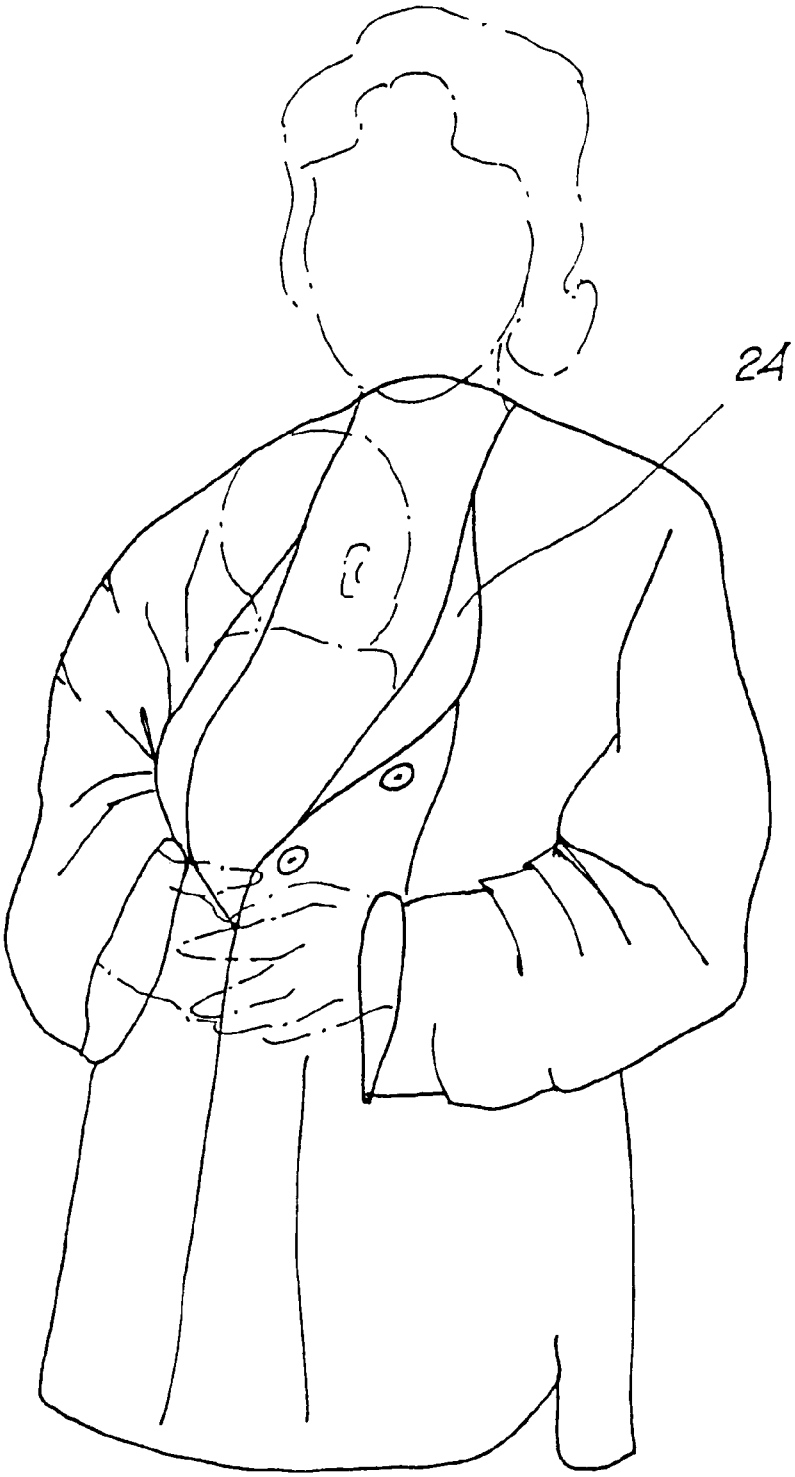
FIG. 16 is a front view of a full term infant sitting in the seater pouch with an open neckline and with the adult standing.

FIG. 16 shows another feature in a preferred embodiment as the adult stands with an open neckline 24 to show how the present invention provides for ready access to the seater pouches 50 or 52.

In a preferred embodiment sizing of the upper body garment may be for the average medium, large and extra large sized post-partum female. Though size is based on the need to breast feed, adult males can used appropriate size for their weight. From the foregoing description, it will be seen that an upper body garment constructed according to the invention is capable of providing secure contact between a human and infant of varying size.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

What is claimed is:

1. An article of upper body clothing for providing contact between a person and an infant in the form of a shirt or blouse comprising:

a front and rear portion connected together having neck, waist and arm openings, said portion being made of a cloth material, said front portion having an interior area and an exterior area with the interior area being positioned adjacent to a person's body, and a pouch which is positioned on the interior area of the front portion and substantially centrally located thereon, said pouch having an upper opening in which an infant may be placed in an upright position whilst being supported thereby so as to provide skin to skin contact between the person and the infant.

2. The invention in accordance with claim 1 wherein the neck opening is of sufficient size so as to place the infant in the pouch of the person wearing the article of clothing.

3. The invention in accordance with claim 1 which further includes a placket on the front portion through which the infant may be placed in the pouch.

4. The invention in accordance with claim 3 wherein the placket extends from the neck opening down the front portion.

5. The invention in accordance with claim 4 wherein the placket may be opened or securely closed a desired amount.

6. The invention in accordance with claim 3 wherein said pouch includes two side portions and a bottom portion, said pouch being securely affixed to the interior of the front portion, said side portions being positioned on opposite sides of the placket and said bottom portion being positioned below said placket.

7. The invention in accordance with claim 6 wherein the upper opening of the pouch is adjustable so as to accommodate infants of varying sizes.

8. The invention in accordance with claim 7 which includes an elastic means extending across the upper opening of the pouch and affixed on either side of the placket which allows for adjustment of the upper opening of the pouch.

9. The invention in accordance with claim 1 wherein said pouch is a first pouch, said article of clothing further including a second pouch larger than the first pouch and supported on the interior surface of the front portion.

10. The invention in accordance with claim 9 wherein said second pouch has an upper opening which an infant may be placed; said first pouch being affixed to said second pouch and supported thereby, said second pouch being affixed to the interior of the front portion and being supported thereby.

11. The invention in accordance with claim 10 which further includes a placket on the front portion through which the infant may be placed in either the first or second pouch.

12. The invention in accordance with claim 11 wherein the placket extends from the neck opening down the front portion.

13. The invention in accordance with claim 12 wherein the placket may be opened or securely closed a desired amount.

14. The invention in accordance with claim 10 wherein said second pouch includes two side portions and a bottom portion, said side portions being positioned on opposite sides of the placket and said bottom portion being positioned below said placket and said bottom portion including leg openings for the infant's legs.

15. The invention in accordance with claim 14 wherein the upper opening of the first pouch is adjustable so as to accommodate infants of varying sizes.

16. The invention in accordance with claim 15 which includes an elastic means extending across the upper opening of the pouch and affixed on either side of the placket which allows for adjustment of the upper opening of the pouch.

* * * * *